US010919164B2

(12) United States Patent
Gilbertson

(10) Patent No.: US 10,919,164 B2
(45) Date of Patent: Feb. 16, 2021

(54) UTILITY KNIFE WITH RETRACTABLE BLADE

(71) Applicant: Tyler J. Gilbertson, Florissant, CO (US)

(72) Inventor: Tyler J. Gilbertson, Florissant, CO (US)

( * ) Notice: Subject to any disclaimer, the term of this patent is extended or adjusted under 35 U.S.C. 154(b) by 0 days.

(21) Appl. No.: 16/453,494

(22) Filed: Jun. 26, 2019

(65) Prior Publication Data

US 2020/0001477 A1 Jan. 2, 2020

Related U.S. Application Data

(60) Provisional application No. 62/691,389, filed on Jun. 28, 2018.

(51) Int. Cl.
*B26B 5/00* (2006.01)
*B67B 7/16* (2006.01)

(52) U.S. Cl.
CPC ..... *B26B 5/001* (2013.01); *B67B 7/16* (2013.01)

(58) Field of Classification Search
CPC ..... B26B 5/001; B67B 7/16
See application file for complete search history.

(56) References Cited

U.S. PATENT DOCUMENTS 5,406,707 A * 4/1995 Owens ..... B26B 5/001 30/162
5,475,925 A * 12/1995 Newman ..... B26B 5/001 30/162
5,864,954 A * 2/1999 Harrington ..... B26B 5/001 30/162
8,584,302 B2 * 11/2013 Stroup ..... B26B 5/001 15/236.01
10,478,977 B2 * 11/2019 Rohrbach ..... B26B 1/08
10,632,633 B2 * 4/2020 Bloch ..... B26B 11/00
2008/0250650 A1 * 10/2008 Seber ..... B26B 5/001 30/161
2009/0223062 A1 * 9/2009 Tucker ..... B26B 5/001 30/162
2009/0241345 A1 * 10/2009 Huang ..... B26B 5/001 30/123
2010/0199501 A1 * 8/2010 Hernandez ..... B26B 7/00 30/162
2011/0041345 A1 * 2/2011 Austin ..... B26B 5/001 30/162
2014/0041235 A1 * 2/2014 Hsu ..... B26B 5/005 30/162

(Continued)

*Primary Examiner* — Omar Flores Sanchez
(74) *Attorney, Agent, or Firm* — Duft & Bornsen, PC

(57) ABSTRACT

A utility knife that includes a handle having a blade slot, and a knife blade slidably housed in the blade slot. The knife blade is configured to extend and retract longitudinally from a blade slot opening of the blade slot. A first side of the handle includes a blade adjustment opening that exposes a first side of the knife blade to extend and retract the knife blade. A second side of the handle includes a biasing member that applies a lateral force against a second side of the knife blade to bias the knife blade against the first side of the handle. The first side of the handle includes one or more blade stops that engage the knife blade when biased against the first side of the handle to lock the knife blade at a selectable position.

20 Claims, 12 Drawing Sheets

(56) References Cited

U.S. PATENT DOCUMENTS

| | | | | |
|---|---|---|---|---|
| 2014/0053408 | A1* | 2/2014 | Ho | B26B 27/005 30/152 |
| 2014/0150268 | A1* | 6/2014 | Billado, Jr. | B26B 1/08 30/162 |
| 2014/0373363 | A1* | 12/2014 | Billado, Jr. | B26B 1/08 30/152 |
| 2015/0217461 | A1* | 8/2015 | Langenwalter | B26B 1/042 7/118 |
| 2016/0221813 | A1* | 8/2016 | Crane | B67B 7/16 |
| 2017/0008744 | A1* | 1/2017 | Macon | B67B 7/16 |
| 2017/0231272 | A1* | 8/2017 | Pontano | A24F 29/00 206/101 |
| 2017/0267509 | A1* | 9/2017 | Schuld | B67B 7/16 |
| 2017/0340509 | A1* | 11/2017 | van den Dries | A61H 7/003 |
| 2018/0021964 | A1* | 1/2018 | Rohrbach | B26B 1/08 30/162 |
| 2018/0360108 | A1* | 12/2018 | King, Jr. | A24F 3/00 |
| 2019/0077031 | A1* | 3/2019 | Gallegos | B26B 5/001 |
| 2019/0176349 | A1* | 6/2019 | Hansen | B26B 9/00 |
| 2019/0224861 | A1* | 7/2019 | Bloch | B26B 5/001 |
| 2019/0351565 | A1* | 11/2019 | Ronan | B26B 5/003 |

* cited by examiner

UTILITY KNIFE WITH RETRACTABLE BLADE

RELATED APPLICATIONS

This non-provisional application claims priority to U.S. provisional application 62/691,389, filed on Jun. 28, 2018, which is incorporated herein by reference as if fully provided herein.

FIELD

This disclosure relates to the field of knives, and more particularly, to a utility knife with a retractable blade.

BACKGROUND

A utility knife is a type of knife typically designed for multi-purpose cutting, such as for cutting tape, cords, strapping, cardboard, packaging material, etc. A conventional utility knife includes a hollow handle, and a blade holder movably mounted within the handle. A replaceable blade is mounted on the blade holder within the handle. The blade holder is movable between a retracted position where the blade is disposed within the handle, and an extended position where the blade protrudes outwardly from a cutting end of the handle. A thumb mechanism is connected to the blade holder to move the blade holder between the extended and retracted positions.

SUMMARY

Described herein is a compact and light-weight utility knife. The handle of the utility knife houses a knife blade, and the design of the handle allows a user to contact a side of the knife blade. By pressing against the side of the knife blade, the user is able to disengage the knife blade from blade stops in the handle so that the knife blade is free to move. The user may then manually slide the knife blade for extending and retracting. One benefit is a person may use one hand to extend/retract the knife blade by pressing on the side of the knife blade. And, the knife blade automatically locks and is rigidly supported at different positions when the user releases pressure on the side of the knife blade. Thus, adjustment of the blade position is easy, and a separate blade holder and thumb mechanism is not needed. Another benefit is that the utility knife is simply and economically constructed with a minimum number of parts.

One embodiment comprises a utility knife that includes a handle having a blade slot, and a knife blade slidably housed in the blade slot. The knife blade is configured to extend and retract longitudinally from a blade slot opening of the blade slot. A first side of the handle includes a blade adjustment opening that exposes a first side of the knife blade to extend and retract the knife blade. A second side of the handle includes a biasing member that applies a lateral force against a second side of the knife blade to bias the knife blade against the first side of the handle. The first side of the handle includes one or more blade stops that engage the knife blade when biased against the first side of the handle to lock the knife blade at a selectable position.

In another embodiment, one or more of the blade stops engages an inclined end edge of the knife blade when biased against the first side of the handle to lock the knife blade at a retracted position.

In another embodiment, one or more of the blade stops engages one or more locking notches on a top end of the knife blade when biased against the first side of the handle to lock the knife blade at an extended position.

In another embodiment, the blade stops are disposed at a top of the blade adjustment opening.

In another embodiment, the blade stops project partially across the blade slot in a lateral direction.

In another embodiment, the blade adjustment opening and the biasing member are laterally aligned.

In another embodiment, the blade adjustment opening is sized to accommodate a finger of a human operator.

In another embodiment, the biasing member comprises a flat spring member formed by a U-shaped groove through the second side of the handle. The flat spring member is bent laterally inward to contact the second side of the knife blade.

In another embodiment, the handle further includes grip members disposed at a top end of the handle to assist a human operator in grasping the handle.

In another embodiment, the handle further includes a bottle opener disposed at the blade slot opening.

In another embodiment, the handle further includes a lanyard hole disposed at a rear end of the handle.

Another embodiment comprises a utility knife that includes a handle comprised of a first handle member and a second handle member that are detachably secured and separable along a longitudinal plane. The utility knife further includes a retractable blade, and a blade slot between the first handle member and the second handle member configured to house the retractable blade. The first handle member includes a blade adjustment opening that exposes a first side of the retractable blade, and includes one or more blade stops. The second handle member includes a biasing member that applies a lateral force against a second side of the retractable blade to press the retractable blade toward the first handle member. The blade stops are configured to engage the retractable blade when the biasing member presses the retractable blade toward the first handle member to lock the retractable blade at a selectable position.

In another embodiment, the blade stops are configured to disengage from the retractable blade in response to an opposing lateral force applied through the blade adjustment opening to allow for longitudinal sliding of the retractable blade between a retracted position and an extended position.

In another embodiment, one or more of the blade stops engages an inclined end edge of the retractable blade when pressed towards the first handle member to lock the retractable blade at the retracted position.

In another embodiment, one or more of the blade stops engages one or more locking notches on a top end of the retractable blade when pressed towards the first handle member to lock the retractable blade at the extended position.

In another embodiment, the first handle member is comprised of a first side cover plate having an outer surface and an inner surface that are flat. The blade adjustment opening is disposed through the first side cover plate, and the blade stops project laterally from the inner surface of the first side cover plate.

In another embodiment, the second handle member is comprised of a second side cover plate having an outer surface that is flat, and having an inner surface that includes a flange that projects laterally from the second side cover plate along a top end, a rear end, and a bottom end to form a recess in the second handle member that defines the blade slot.

In another embodiment, the flange projects laterally further from the inner surface of the second side cover plate than the blade stops project laterally from the inner surface of the first side cover plate.

In another embodiment, the biasing member comprises a flat spring member formed by a U-shaped groove through the second side cover plate. The flat spring member is bent laterally inward to contact the second side of the retractable blade.

Another embodiment comprises a method of operating a utility knife. The method includes housing a knife blade in a blade slot of a handle of the utility knife, applying a lateral force against one side of the knife blade with a biasing member of the handle to bias the knife blade toward a first side of the handle and engage one or more blade stops disposed on the first side of the handle, pressing laterally against an opposite side of the knife blade through a blade adjustment opening in the first side of the handle to disengage the knife blade from the blade stops, sliding the knife blade longitudinally through the blade adjustment opening to extend or retract the knife, and releasing the knife blade to engage the blade stops via the biasing member to lock the knife blade at a new position.

The features, functions, and advantages that have been discussed can be achieved independently in various embodiments or may be combined in yet other embodiments, further details of which can be seen with reference to the following description and drawings.

DESCRIPTION OF THE DRAWINGS

Some embodiments of the present invention are now described, by way of example only, with reference to the accompanying drawings. The same reference number represents the same element or the same type of element on all drawings.

DETAILED DESCRIPTION

The figures and the following description illustrate specific exemplary embodiments. It will be appreciated that those skilled in the art will be able to devise various arrangements that, although not explicitly described or shown herein, embody the principles described herein and are included within the contemplated scope of the claims that follow this description. Furthermore, any examples described herein are intended to aid in understanding the principles of the disclosure, and are to be construed as being without limitation. As a result, this disclosure is not limited to the specific embodiments or examples described below, but by the claims and their equivalents.

Figure 1:
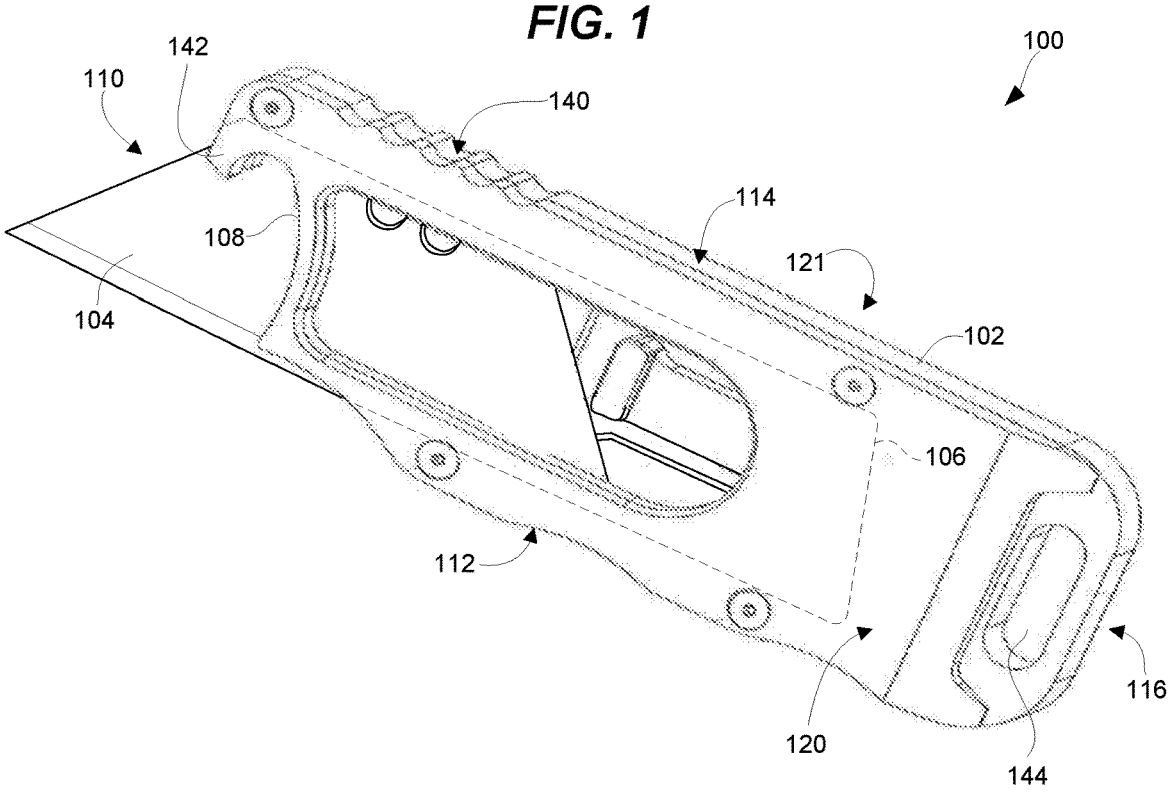
FIGS. 1-2 are perspective views of a utility knife in an illustrative embodiment.
Figure 2:
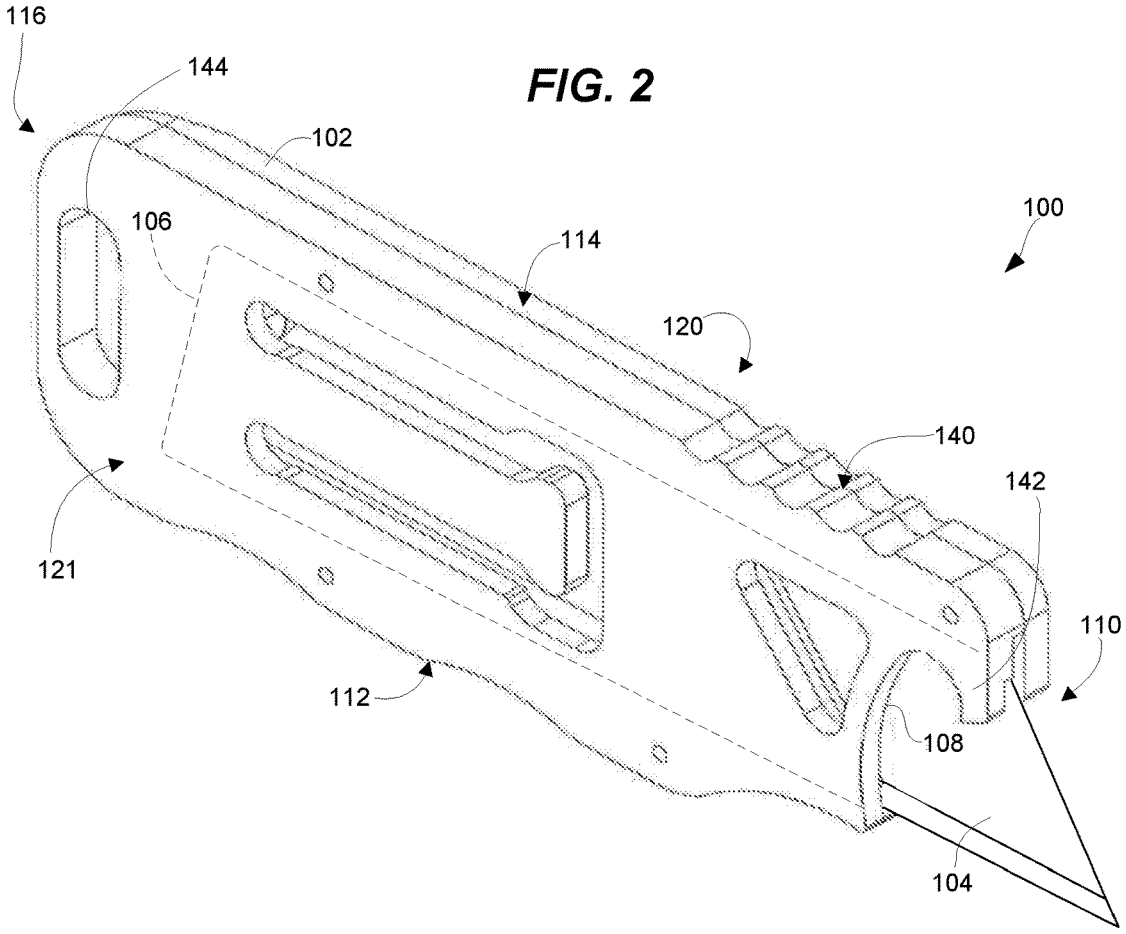

FIGS. 1-2 are perspective views of a utility knife 100 in an illustrative embodiment. In FIG. 1, utility knife 100 includes a handle 102 and a knife blade 104. Handle 102 is an elongated member that is configured to be grasped by a user for cutting. Handle 102 includes a blade slot 106 (shown schematically with dotted lines) that is configured to slidably house knife blade 104 so that knife blade 104 is retractable. Blade slot 106 is slightly larger in length and width than knife blade 104. Knife blade 104 is configured to extend and retract longitudinally from a blade slot opening 108 disposed toward a front end 110 of handle 102. The bottom end 112 of handle is closed to cover a cutting edge of knife blade 104. In this embodiment, the top end 114 and rear end 116 of handle 102 are also closed. However, there may be smaller openings in top end 114 and rear end 116 if desired, such as to reduce weight of utility knife 100.

The shape of handle 102 is generally flat as opposing sides 120-121 of handle 102 are planar. However, handle 102 may have other shapes in other embodiments. Utility knife 100 may be considered a "pocket-sized" knife having a size suitable for carrying in a pocket. Thus, handle 102 may have a length (between front end 110 and rear end 116) in the range of about three to four inches, a width (between sides 120-121) in the range of about a quarter inch to a half inch, and a height (between bottom end 112 and top end 114) in the range of about one inch to one and a half inches. The dimensions above are provided as an example, and handle 102 may have other dimensions in other embodiments.

Figure 3:
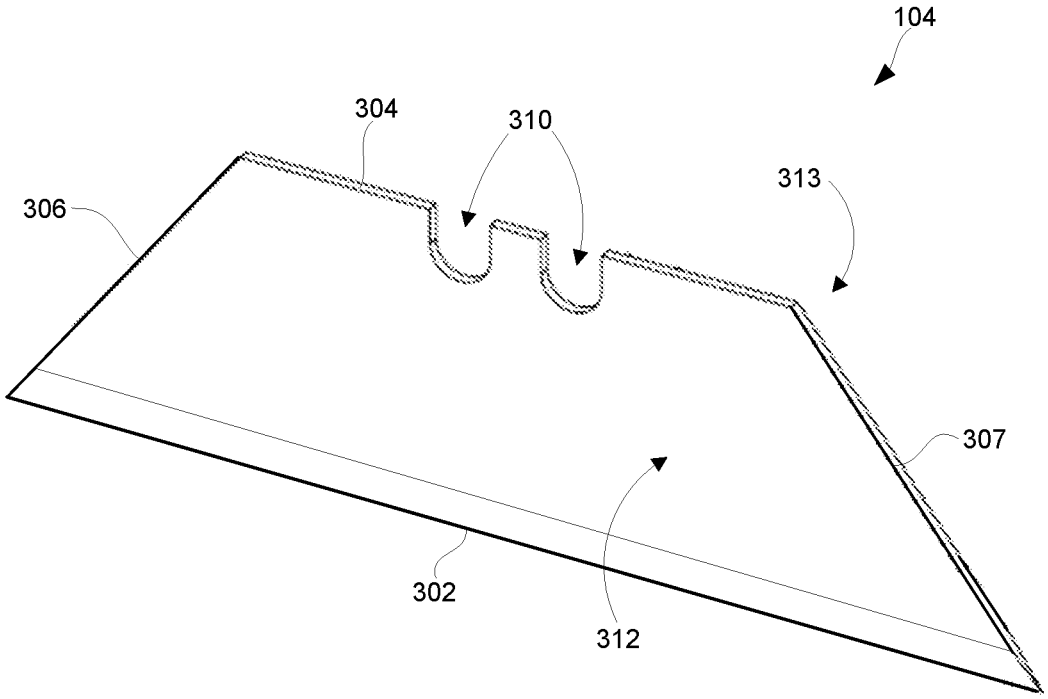
FIG. 3 is a perspective view of a knife blade.

FIG. 3 is a perspective view of knife blade 104. Knife blade 104 is trapezoidal in shape having a cutting edge 302, a top edge 304 opposite cutting edge 302, and inwardly inclined end edges 306-307 between cutting edge 302 and top edge 304. Knife blade 104 includes one or more locking notches 310 or tangs disposed at top edge 304. Although two locking notches 310 are shown in FIG. 3, knife blade 104 may include more or less locking notches 310 as desired. Knife blade 104 also includes opposing sides 312-313, which represent the major surfaces of knife blade 104. In the embodiments described herein, knife blade 104 is replaceable in utility knife 100.

In FIGS. 1-2, the structure of handle 102 allows for easy adjustment of the position of knife blade 104 between a retracted position and one or more extended positions. A conventional utility knife includes a blade holder on which a knife blade is mounted, and the position of the blade holder is generally adjusted via a thumb mechanism on the top end of the knife. The structure of handle 102 allows for mounting and adjustment of knife blade 104 without the need of a blade holder. The user manually moves the knife blade 104 through an opening in handle 102, and handle 102 is configured to lock knife blade 104 at selectable positions between retracted and fully extended as is described in more detail below.

Figure 4:
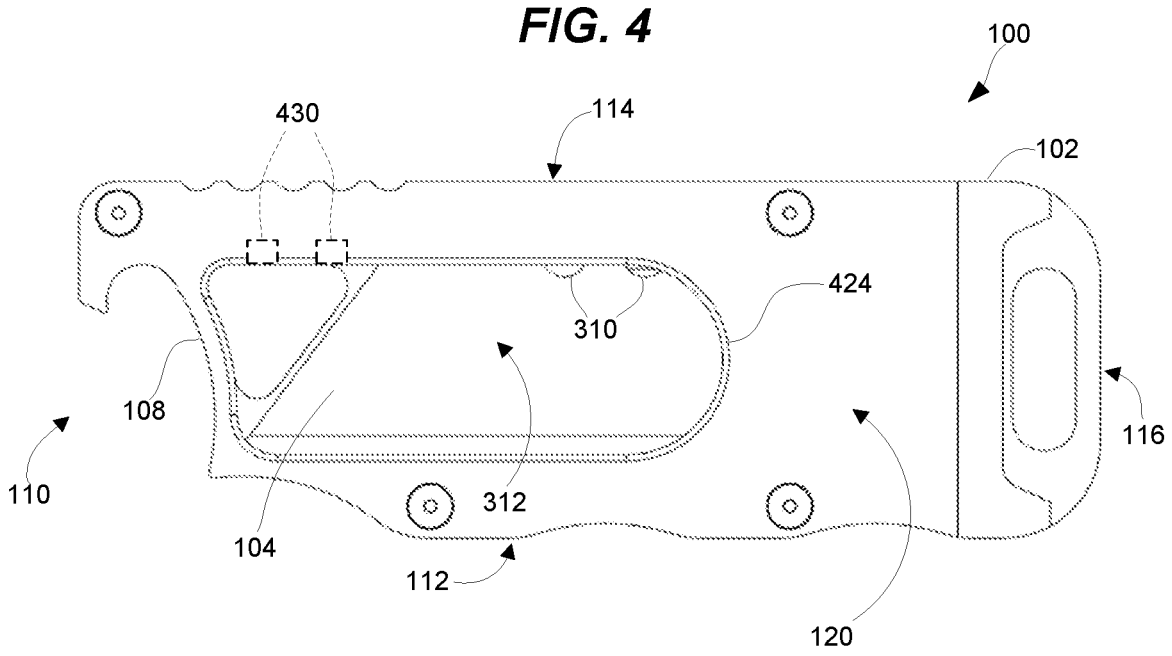
FIGS. 4-5 are side views of a utility knife in illustrative embodiments.
Figure 5:
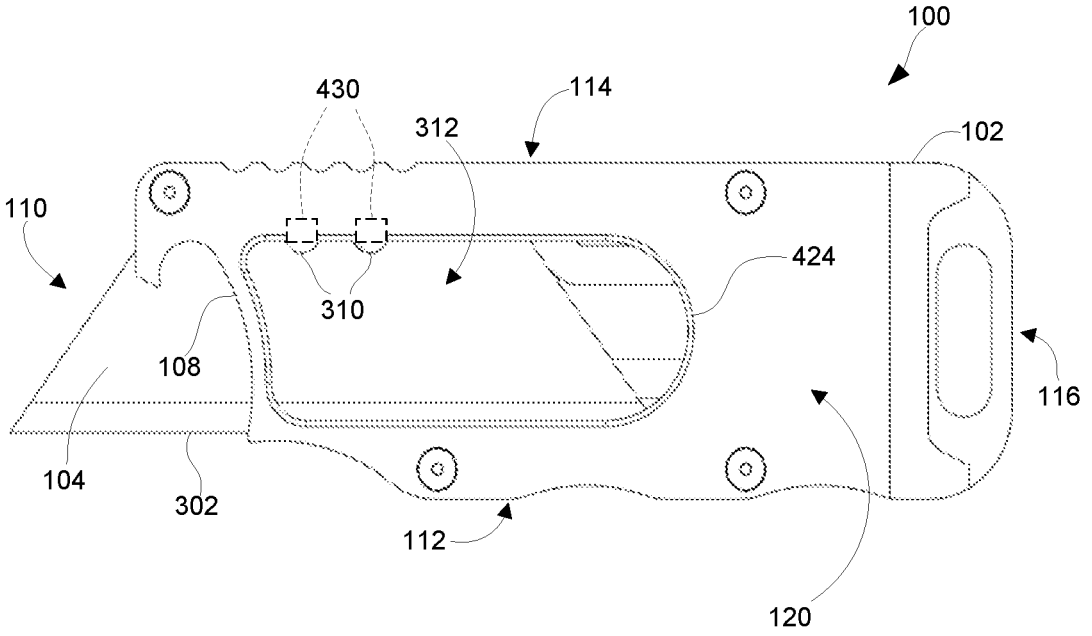

FIGS. 4-5 are side views of utility knife 100 in illustrative embodiments. FIG. 4 illustrates side 120 of handle 102 with knife blade 104 in a retracted position, and FIG. 5 illustrates side 120 of handle 102 with knife blade 104 in an extended position. Side 120 of handle 102 includes a blade adjustment opening 424 that exposes one side (i.e., side 312) of knife blade 104. Blade adjustment opening 424 is an elongated opening configured to provide a user access to a side 312 of knife blade 104 for adjusting the longitudinal position of knife blade 104 (i.e., extending and retracting). Side 312 of knife blade 104 is flat and does not have sharp edges, so a user can safely contact the side 312 of knife blade 104 directly. Blade adjustment opening 424 is sized to accommodate a finger of a human operator. For example, blade adjustment opening 424 may have a length (between front end 110 and rear end 116) in the range of about one to two inches, and a height (between bottom end 112 and top end 114) in the range of about one half to three-quarter inches. The dimensions above are provided as an example, and blade adjustment opening 424 may have other dimensions in other embodiments. In another embodiment, a gripping member or the like be attached to the side 312 of knife blade 104 to assist a human operator in sliding knife blade 104.

Figure 6:
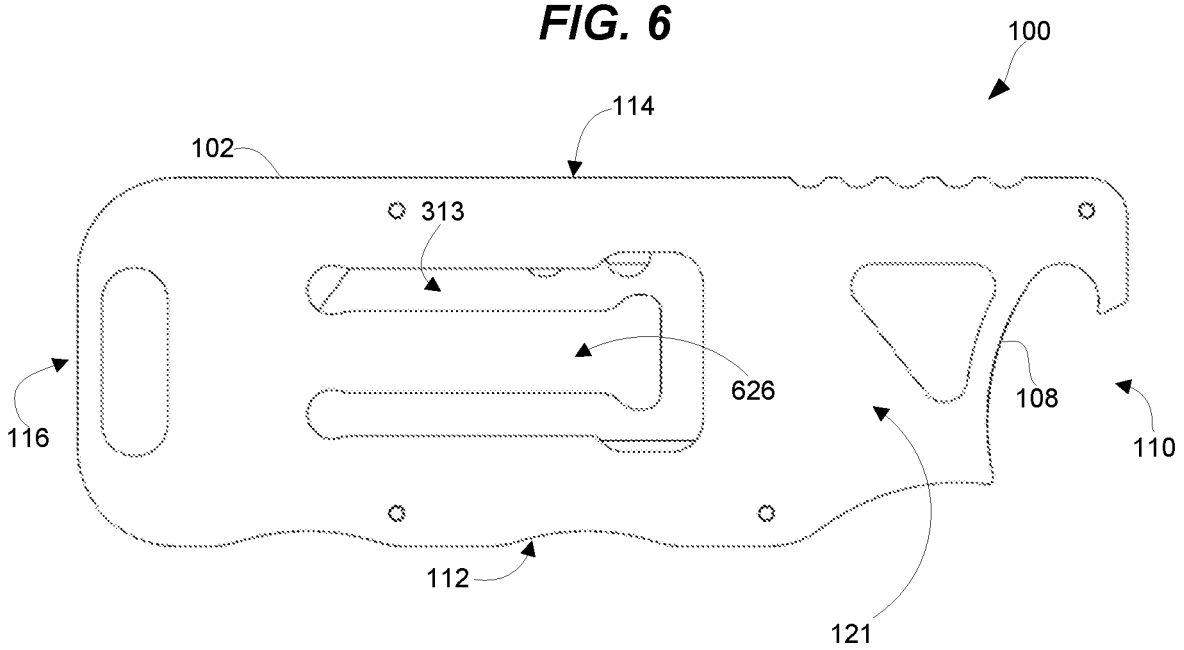
FIGS. 6-7 are side views of a utility knife in illustrative embodiments.
Figure 7:
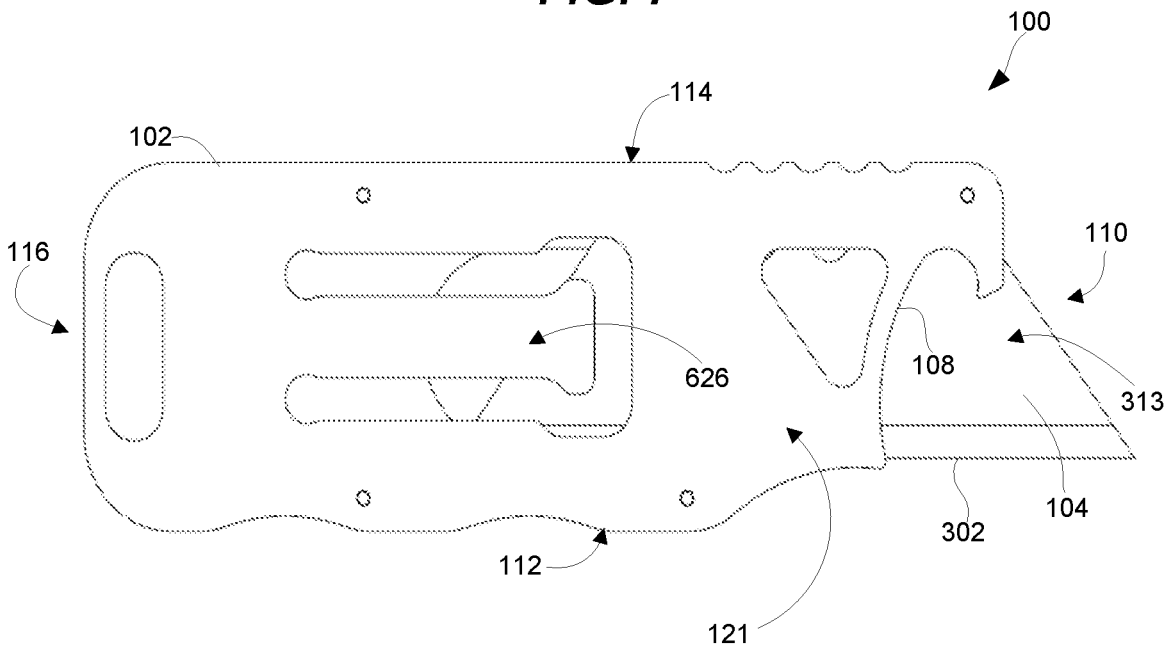

FIGS. 6-7 are side views of utility knife 100 in illustrative embodiments. FIG. 6 illustrates side 121 of handle 102 with knife blade 104 in a retracted position, and FIG. 7 illustrates side 121 of handle 102 with knife blade 104 in an extended position. Side 121 of handle 102 includes a biasing member 626 that applies a lateral force or otherwise presses against the side 313 of knife blade 104, which is opposite the side 312 that is exposed through blade adjustment opening 424. Biasing member 626 is configured to bias, press, or push knife blade 104 against side 120 of handle 102. Blade adjustment opening 424 and biasing member 626 are laterally aligned on opposing sides 120-121, respectively, of handle 102. Thus, a lateral or pressing force by a human operator against side 312 of knife blade 104 through blade adjustment opening 424 is able to counteract or overcome the lateral force of biasing member 626 to adjust the longitudinal position of knife blade 104.

In FIGS. 4-5, side 120 of handle 102 further includes one or more blade stops 430 (shown schematically in dotted lines) that are configured to engage locking notches 310 or an inclined end edge 306-307 on knife blade 104. When knife blade 104 is biased against side 120 of handle 102, a blade stop 430 of handle 102 is configured to engage an inclined end edge 306-307 of knife blade 104 to lock knife blade 104 in a retracted position. One or more blade stops 430 are configured to engage locking notches 310 on knife blade 104 to lock knife blade 104 at one or more extended positions. Blade stops 430 are configured to disengage from knife blade 104 in response to an opposing lateral force applied through blade adjustment opening 424 to allow for longitudinal sliding of knife blade 104 between a retracted position and an extended position. Thus, to adjust the position of knife blade 104, a human operator presses against side 312 of knife blade 104 to overcome the force of biasing member 626 and disengage blade stops 430 from an inclined end edge 306-307 or locking notches 310. With blade stops 430 free from an inclined end edge 306-307 or locking notches 310, the human operator may slide knife blade 104 longitudinally to either extend or retract knife blade 104 until blade stops 430 again engage an inclined end edge 306-307 or locking notches 310 at a new position. The human operator may repeat these steps to adjust the position of knife blade 104 between a retracted position and one or more extended positions.

FIGS. 1-2 further illustrate optional features of handle 102 in illustrative embodiments. In one embodiment, handle 102 may include grip members 140 disposed at top end 114 to assist a human operator in grasping handle 102. In another embodiment, handle 102 may include a bottle opener 142 disposed at blade slot opening 108. In another embodiment, handle 102 may include a lanyard hole 144 disposed at rear end 116 on handle 102.

Figure 8:
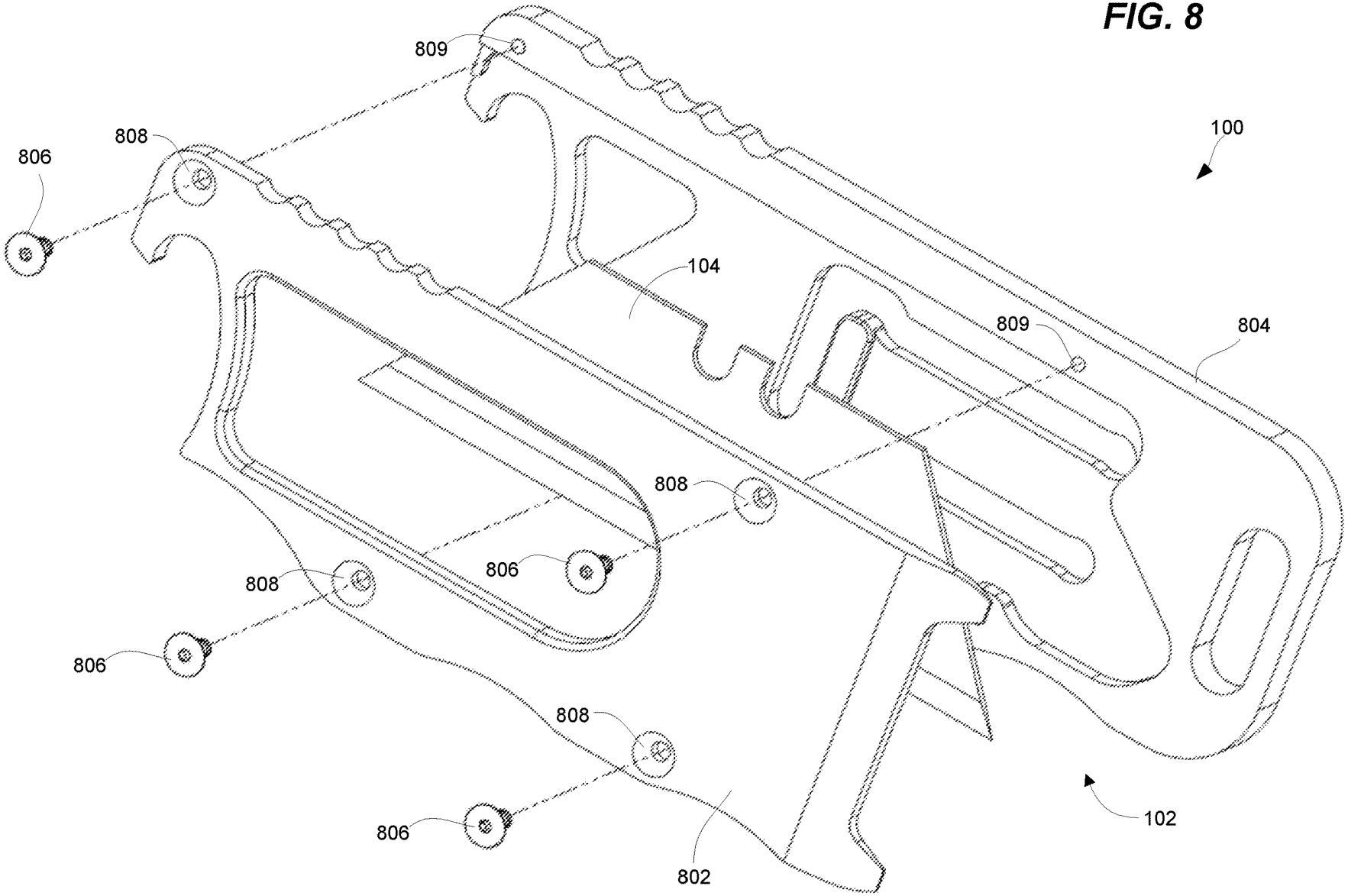
FIGS. 8-9 are exploded perspective views of a utility knife in an illustrative embodiment.
Figure 9:
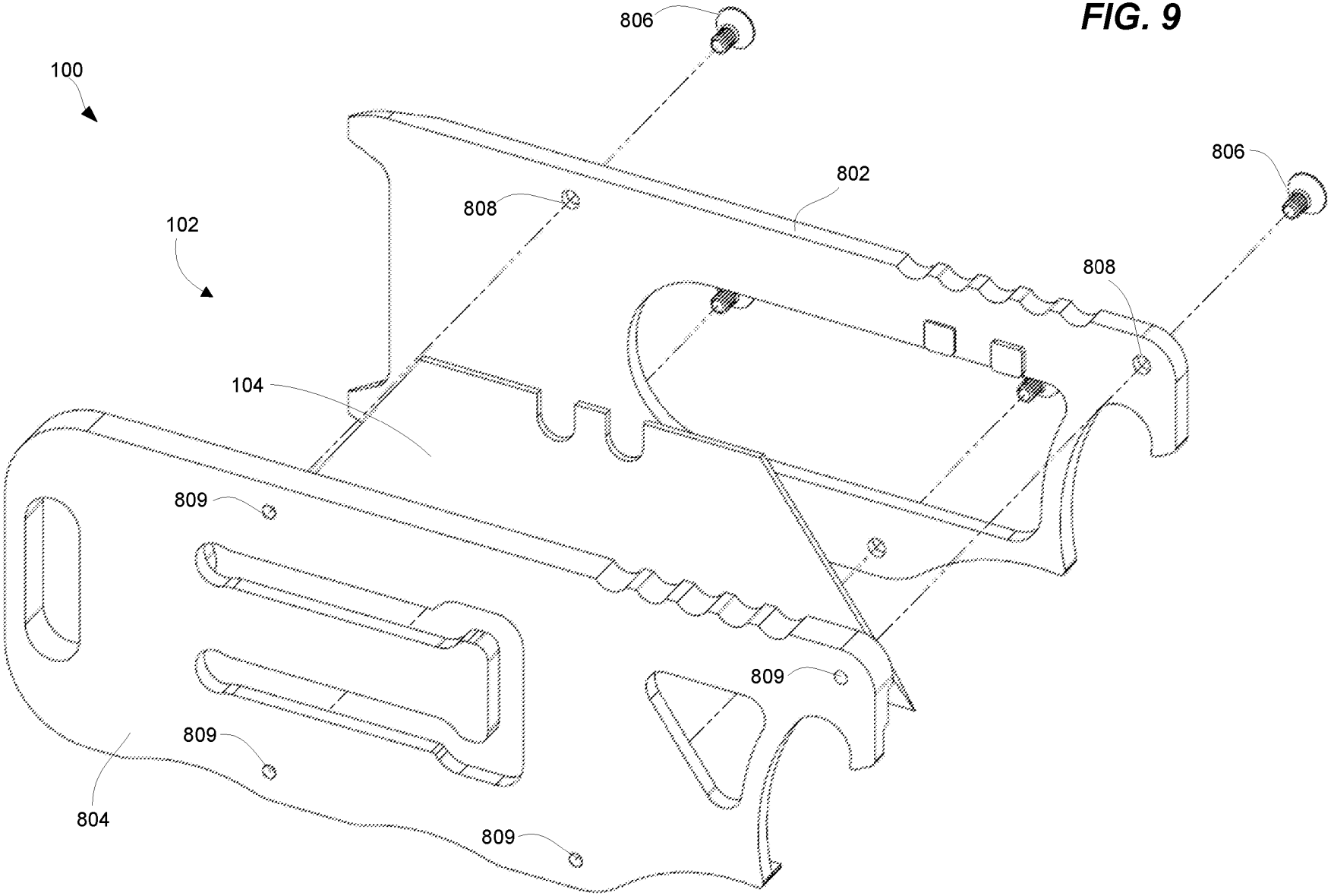

The following figures further illustrate the structural details of utility knife 100 in illustrative embodiments. FIGS. 8-9 are exploded perspective views of utility knife 100. In this embodiment, handle 102 is comprised of two handle members 802, 804 that are detachably secured and separable along a longitudinal plane. Handle members 802, 804 are elongated members made from a rigid material, such as metal, plastic, etc. Handle members 802, 804 may be attached by fasteners 806, such as bolts, screws, pins, etc. In this embodiment, handle member 802 includes fastener holes 808 that are sized for a shank of a fastener 806 to pass through. Fastener holes 808 may further include a countersink so that a head of a fastener 806 sits flush with the surface of handle member 802. Handle member 804 includes threaded holes 809, which are configured to engage corresponding threads on fasteners 806 to secure handle members 802, 804 together. Although handle 102 is illustrated as a multi-piece element in this embodiment, it may have a unibody design in other embodiments.

Figure 10:
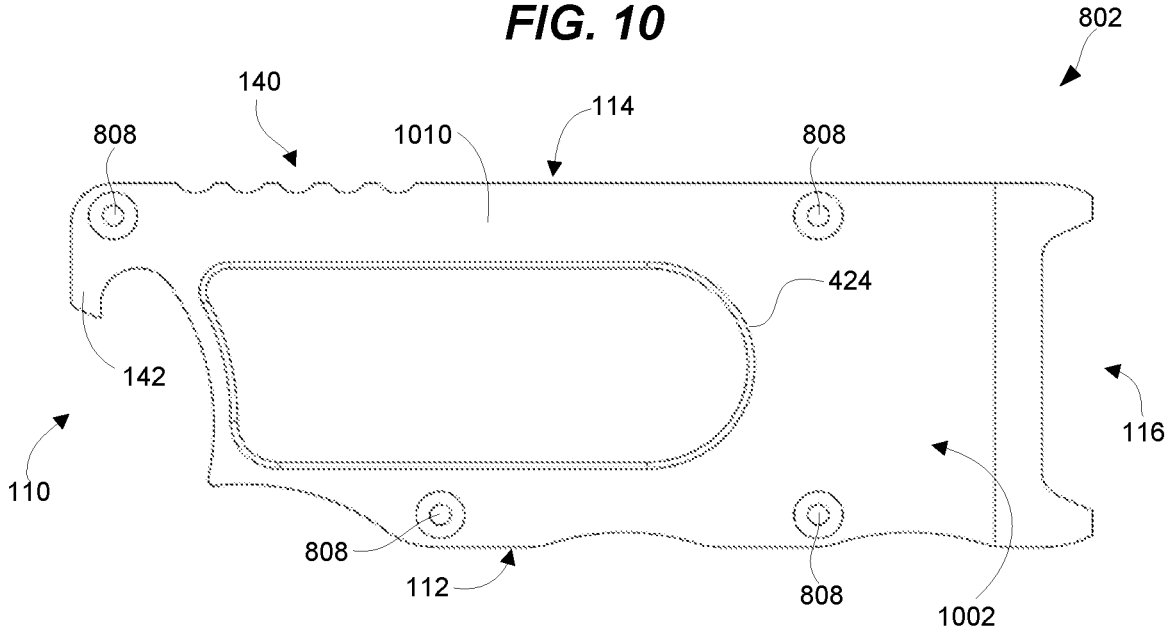
FIGS. 10-11 are side views of a handle member in an illustrative embodiment.
Figure 11:
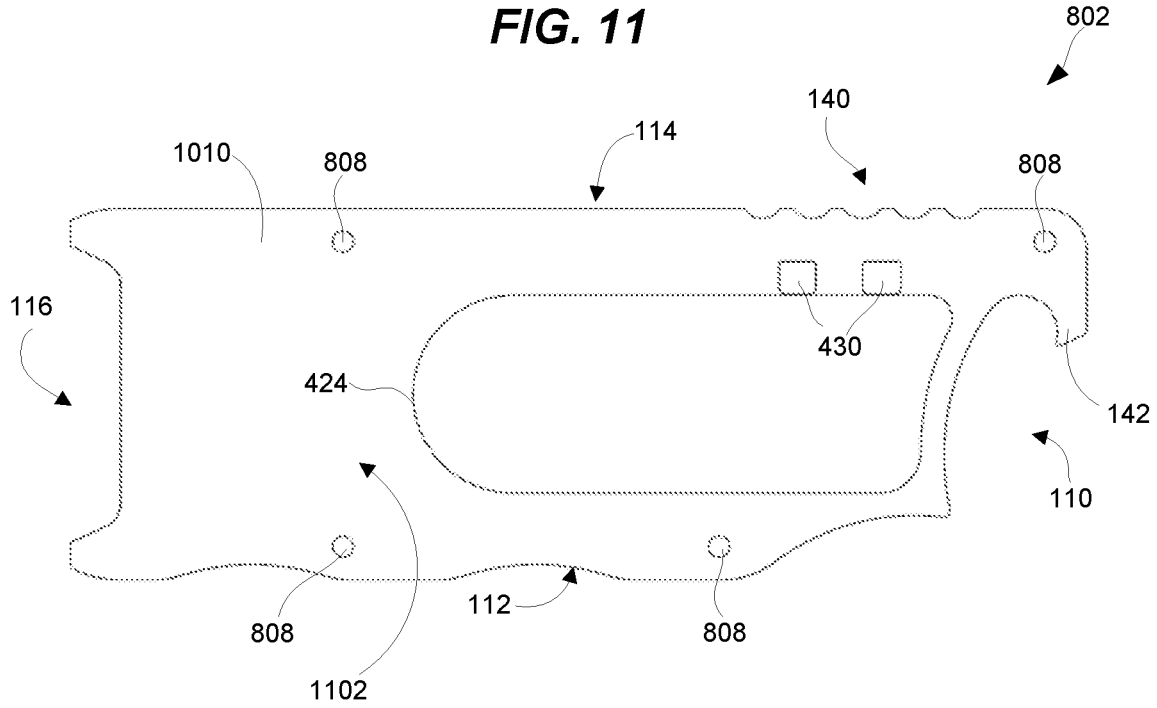

FIGS. 10-11 are side views of handle member 802 in an illustrative embodiment. FIG. 10 shows an outer surface 1002 of handle member 802, and FIG. 11 shows an inner surface 1102 of handle member 802. In this embodiment, handle member 802 is comprised of a side cover plate 1010 that is generally flat. Thus, outer surface 1002 and inner surface 1102 are each planar surfaces. Blade adjustment opening 424 is disposed through side cover plate 1010 from outer surface 1002 to inner surface 1102 at or near a center portion of side cover plate 1010. Fastener holes 808 are also disposed through side cover plate 1010 from outer surface 1002 to inner surface 1102. The periphery of side cover plate 1010 may be machined or otherwise fabricated to form various features of handle 102. For example, the periphery of side cover plate 1010 may define grip members 140 disposed at top end 114, bottle opener 142 disposed at front end 110, etc.

Figure 12:
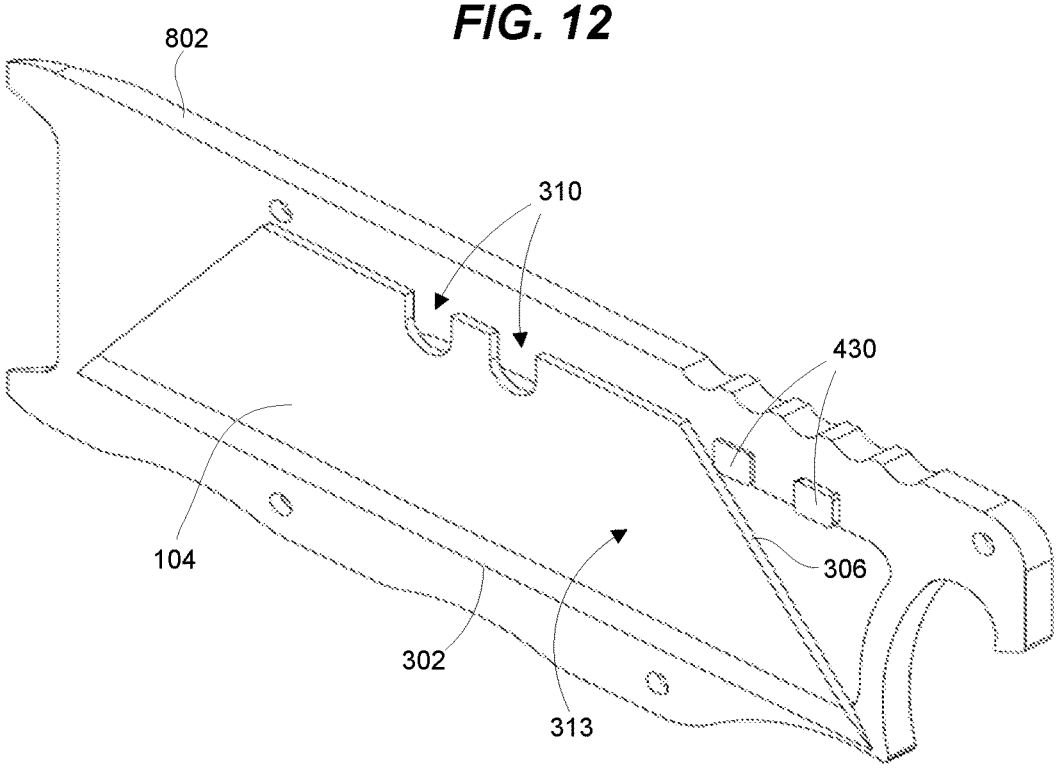
FIGS. 12-13 are perspective views of a knife blade and a handle member in an illustrative embodiment.
Figure 13:
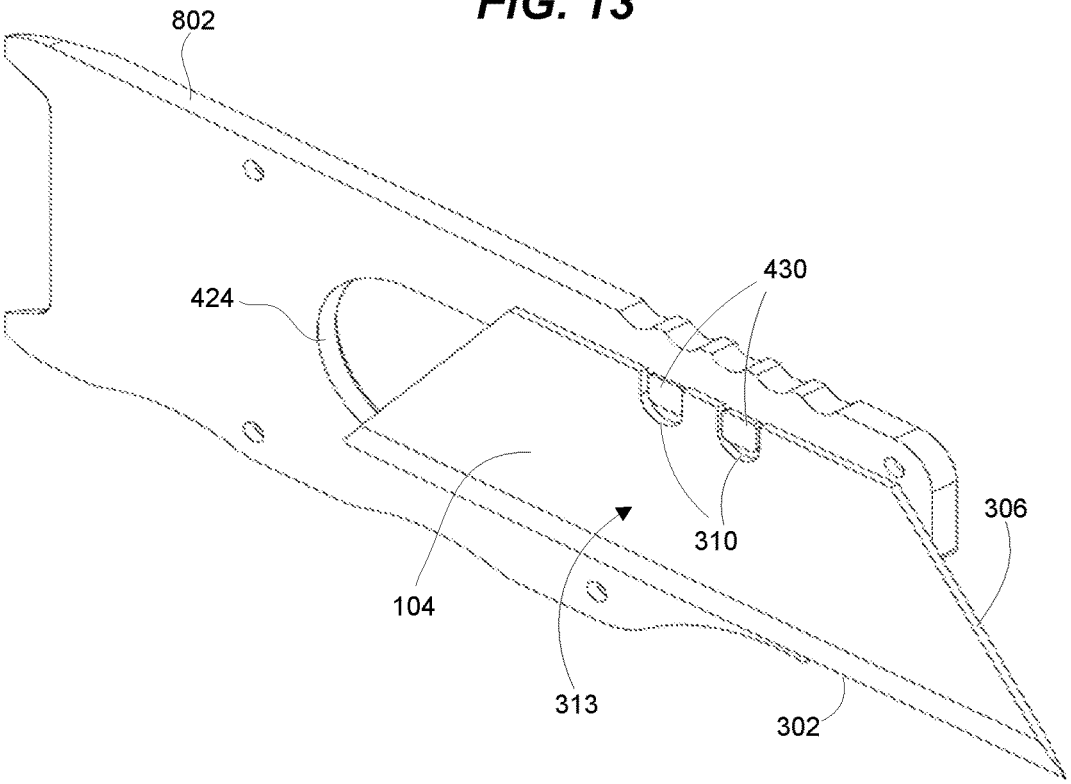

In FIG. 11, side cover plate 1010 includes one or more blade stops 430 that are configured to engage locking notches 310 or an inclined end edge 306-307 on knife blade 104. Blade stops 430 comprise teeth, nubs, protuberances, or some other pieces that project laterally from inner surface 1102. In a vertical direction, blade stops 430 are disposed at or near a top of blade adjustment opening 424 on inner surface 1102. Longitudinally, blade stops 430 are disposed at a location on inner surface 1102 so that knife blade 104 projects from blade slot opening 108 (see FIGS. 1-2) a desired distance. Blade stops 430 project partially across blade slot 106 in a lateral direction so that they engage knife blade 104 when it is biased toward handle member 802, and are disengaged when knife blade 104 is moved toward handle member 804 (see also, FIGS. 8-9). FIGS. 12-13 are perspective views of knife blade 104 and handle member 802 in an illustrative embodiment. It is assumed for FIGS. 12-13 that knife blade 104 is biased toward handle member 802. FIG. 12 illustrates knife blade 104 in a retracted position, where an inclined end edge 306 engages a blade stop 430 to lock knife blade 104 in a retracted position. FIG. 13 illustrates knife blade 104 in one extended position, where locking notches 310 engage blade stops 430 to lock knife blade 104 in the extended position.

Figure 14:
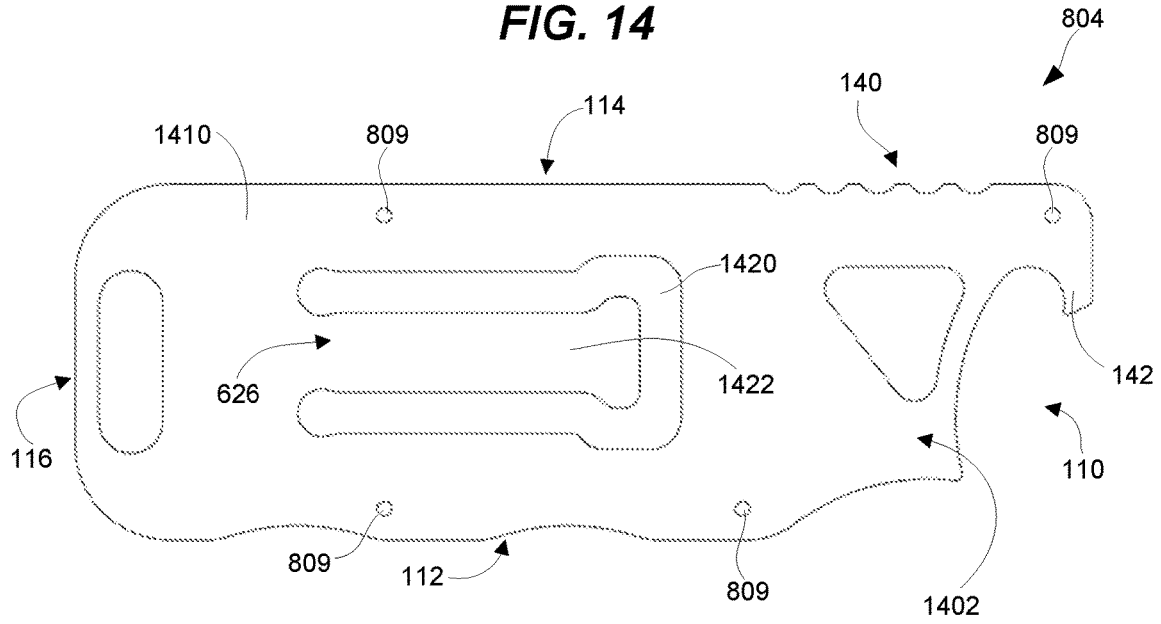
FIGS. 14-15 are side views of another handle member in an illustrative embodiment.
Figure 15:
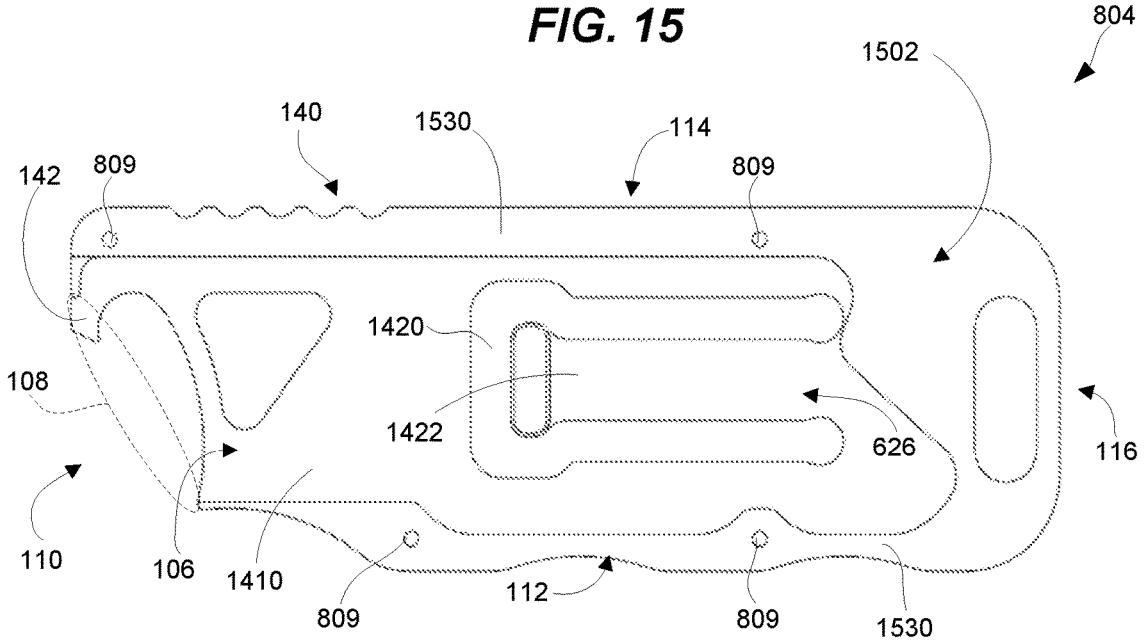

FIGS. 14-15 are side views of handle member 804 in an illustrative embodiment. FIG. 14 shows an outer surface 1402 of handle member 804, and FIG. 15 shows an inner surface 1502 of handle member 804. In this embodiment, handle member 804 is comprised of a side cover plate 1410 having an outer surface 1402 that is generally planar or flat. Biasing member 626 is disposed on handle member 804. In this embodiment, a U-shaped groove 1420 is cut or otherwise formed through side cover plate 1410 from outer surface 1402 to inner surface 1502 to form a flat spring member 1422. Flat spring member 1422 may be bent laterally inward in order to contact knife blade 104 and apply a lateral force against a side 313 of knife blade 104 (see FIG. 3). Threaded holes 809 are also disposed through side cover plate 1410 from outer surface 1402 to inner surface 1502. The periphery of side cover plate 1410 may be machined or otherwise fabricated to form various features of handle 102. For example, the periphery of side cover plate 1410 may define grip members 140 disposed at top end 114, bottle opener 142 disposed at front end 110, etc.

In FIG. 15, handle member 804 further includes a flange 1530 that projects laterally from side cover plate 1410 on inner surface 1502. Flange 1530 comprises a lip or rim disposed partially around the periphery of side cover plate 1410. Flange 1530 is disposed along top end 114, rear end 116, and bottom end 112 to form a recess in handle member 804 that defines blade slot 106. Blade slot 106 provides a track for knife blade 104 to slide longitudinally within handle 102. The front end 110 of side cover plate 1410 is generally flat and devoid of flange 1530 to form blade slot opening 108. Thus, knife blade 104 may project from blade slot opening 108 when knife blade 104 is extended. Flange 1530 may project further from inner surface 1502 of side cover plate 1410 than blade stops 430 project laterally from inner surface 1102 of side cover plate 1010 (see FIG. 11). This ensures that there is room in blade slot 106 for knife blade 104 to shift laterally between engaging blade stops 430 and being disengaged from blade stops 430.

Figure 16:
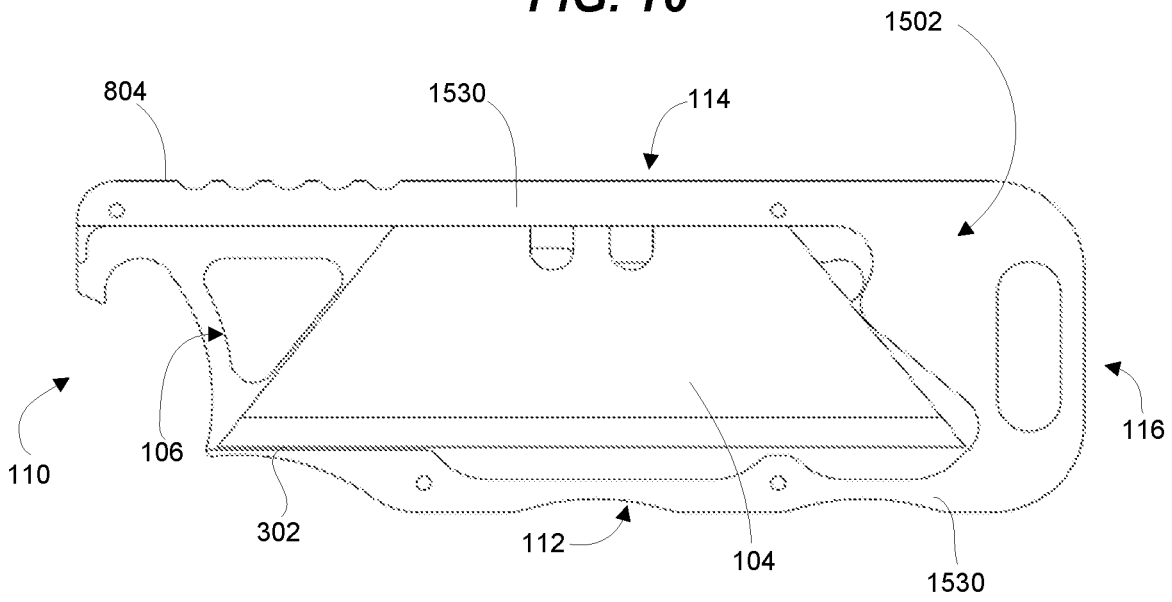
FIGS. 16-17 are side views of a knife blade and another handle member in an illustrative embodiment.
Figure 17:
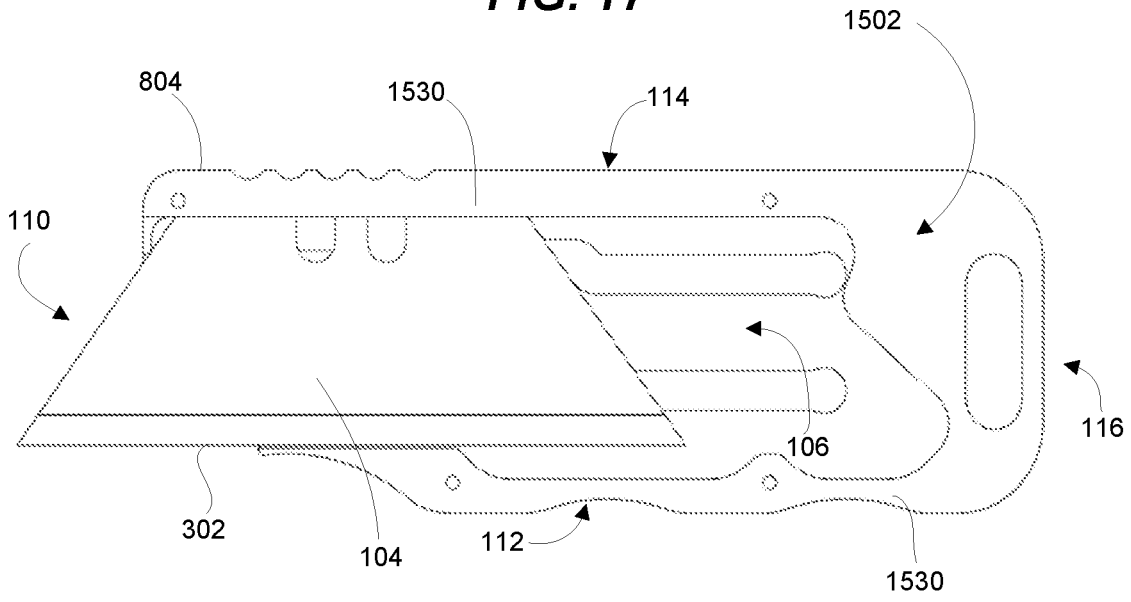

FIGS. 16-17 are side views of knife blade 104 and handle member 804 in an illustrative embodiment. FIG. 16 shows that flange 1530 defines a recess in inner surface 1502 for blade slot 106. FIG. 16 illustrates knife blade 104 in a retracted position, where knife blade 104 is fully withdrawn into blade slot 106. When retracted, no portion of cutting edge 302 of knife blade 104 projects from blade slot 106. FIG. 17 illustrates knife blade 104 in one extended position, where knife blade 104 projects from blade slot 106. Knife blade 104 is in a position for cutting when in an extended position as in FIG. 17.

Figure 18:
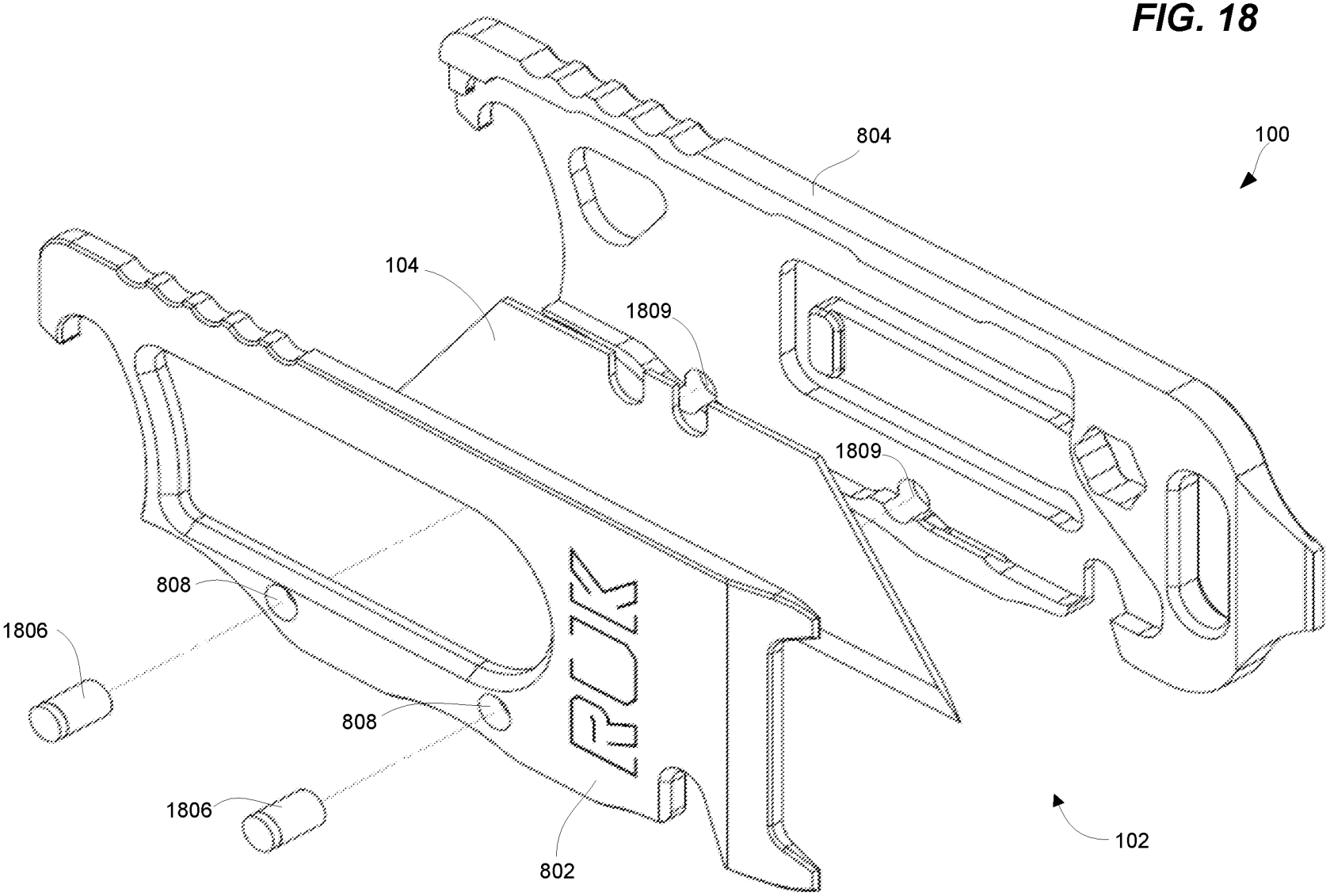
FIG. 18 is an exploded perspective view of a utility knife in another illustrative embodiment.

The structural details of utility knife 100 may vary as desired to accommodate the retractable nature of knife blade 104. FIG. 18 is an exploded perspective view of utility knife 100 in another embodiment. In this embodiment, handle 102 is again comprised of two handle members 802, 804 that are detachably secured and separable along a longitudinal plane. Handle members 802, 804 may be attached by pins 1806. In this embodiment, handle member 802 includes fastener holes 808 that are sized for a shank of a pin 1806 to pass through. Fastener holes 808 may further include a countersink so that a head of a pin 1806 sits flush with the surface of handle member 802. Handle member 804 includes pin holes 1809, which are configured to engage corresponding pins 1806 to secure handle members 802, 804 together.

Figure 19:
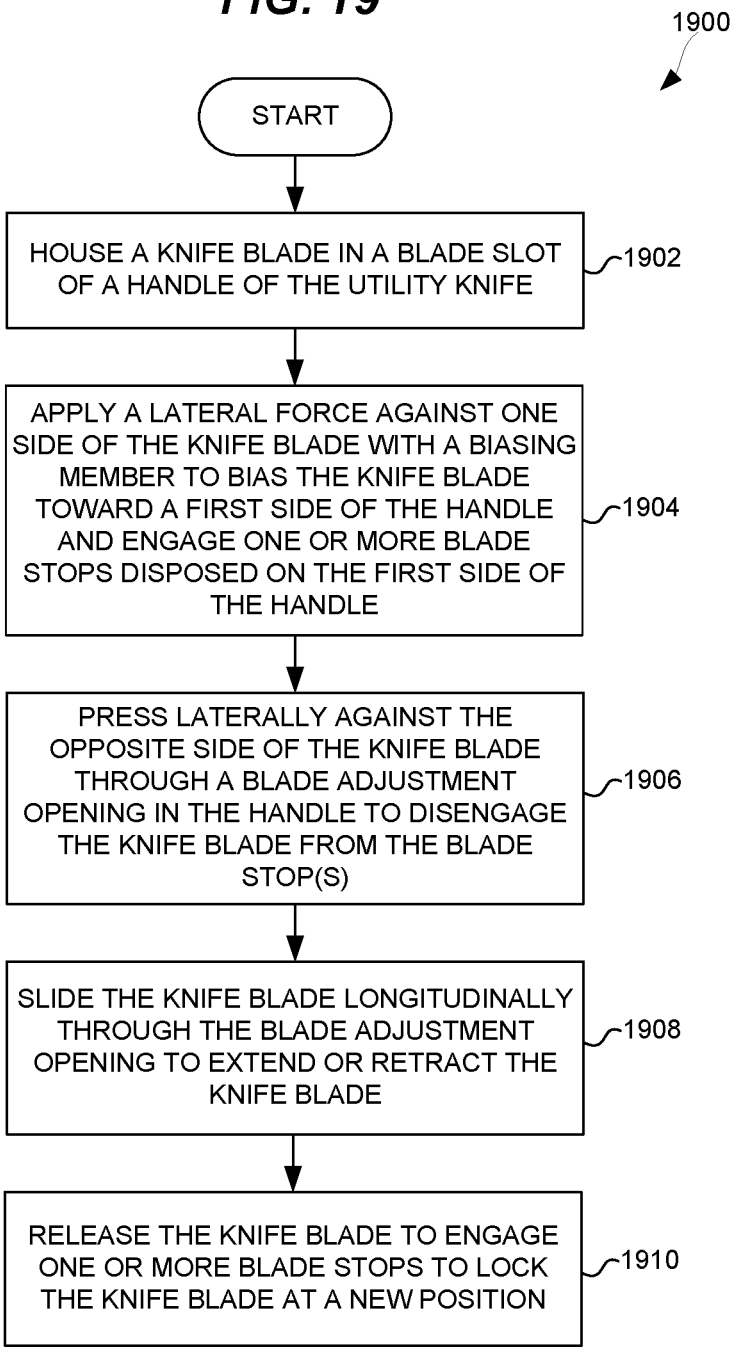
FIG. 19 is a flow chart illustrating a method of operating a utility knife in an illustrative embodiment.

FIG. 19 is a flow chart illustrating a method 1900 of operating a utility knife 100 in an illustrative embodiment. Method 1900 will be discussed in relation to utility knife 100 as described in FIGS. 1-18. As described above, a knife blade 104 is housed in a blade slot 106 of a handle 102 of the utility knife 100 (step 1902). Biasing member 626 applies a lateral force against one side 313 of knife blade 104 to bias knife blade 104 toward an opposing side 120 of handle 102 and engage one or more blade stops 430 disposed on side 120 of handle 102 (step 1904). When knife blade 104 is engaged with one or more blade stops 430, knife blade 104 is locked at a retracted position or one or more extended positions. To adjust the position of knife blade 104, a human operator presses laterally against side 312 of knife blade 104 (i.e., the opposite side of knife blade 104 being pressed by biasing member 626) through blade adjustment opening 424 to disengage knife blade 104 from blade stop(s) 430 (step 1906). With knife blade 104 disengaged from blade stop(s) 430, knife blade 104 is free to move longitudinally. Thus, the human operator slides knife blade 104 longitudinally through blade adjustment opening 424 to extend knife blade 104 from blade slot 106 or retract knife blade 104 into blade slot 106 (step 1908). The human operator then releases knife blade 104 to engage one or more blade stops 430 via biasing member 626 to lock the knife blade 104 at a new position (step 1910). A human operator may repeat steps 1906-1910 any number of times to adjust the position of knife blade 104.

Although specific embodiments were described herein, the scope is not limited to those specific embodiments. Rather, the scope is defined by the following claims and any equivalents thereof.

What is claimed is:

1. A utility knife comprising:

a handle having a blade slot; and a knife blade slidably housed in the blade slot, and configured to extend and retract longitudinally from a blade slot opening of the blade slot;

wherein a first side of the handle includes a blade adjustment opening that exposes a first side of the knife blade to extend and retract the knife blade;

wherein a second side of the handle includes a biasing member that applies a lateral force against a second side of the knife blade to bias the knife blade against the first side of the handle;

wherein the first side of the handle includes one or more blade stops that engage the knife blade when biased against the first side of the handle to lock the knife blade at a selectable position.

2. The utility knife of claim 1 wherein:

at least one of the blade stops engages an inclined end edge of the knife blade when biased against the first side of the handle to lock the knife blade at a retracted position.

3. The utility knife of claim 1 wherein:

at least one of the blade stops engages one or more locking notches on a top end of the knife blade when biased against the first side of the handle to lock the knife blade at an extended position.

4. The utility knife of claim 1 wherein:

the blade stops are disposed at a top of the blade adjustment opening.

5. The utility knife of claim 1 wherein:

the blade stops project partially across the blade slot in a lateral direction.

6. The utility knife of claim 1 wherein:

the blade adjustment opening and the biasing member are laterally aligned.

7. The utility knife of claim 1 wherein:

the blade adjustment opening is sized to accommodate a finger of a human operator.

8. The utility knife of claim 1 wherein the biasing member comprises:

a flat spring member formed by a U-shaped groove through the second side of the handle, wherein the flat spring member is bent laterally inward to contact the second side of the knife blade.

9. The utility knife of claim 1 wherein the handle further includes:

grip members disposed at a top end of the handle to assist a human operator in grasping the handle.

10. The utility knife of claim 1 wherein the handle further includes:

a bottle opener disposed at the blade slot opening.

11. The utility knife of claim 1 wherein the handle further includes:

a lanyard hole disposed at a rear end of the handle.

12. A utility knife comprising:

a handle comprised of a first handle member and a second handle member that are detachably secured and separable along a longitudinal plane;

a retractable blade; and a blade slot between the first handle member and the second handle member configured to house the retractable blade;

the first handle member includes a blade adjustment opening that exposes a first side of the retractable blade, and includes one or more blade stops;

the second handle member includes a biasing member that applies a lateral force against a second side of the retractable blade to press the retractable blade toward the first handle member;

wherein the blade stops are configured to engage the retractable blade when the biasing member presses the retractable blade toward the first handle member to lock the retractable blade at a selectable position.

13. The utility knife of claim 12 wherein:

the blade stops are configured to disengage from the retractable blade in response to an opposing lateral force applied through the blade adjustment opening to allow for longitudinal sliding of the retractable blade between a retracted position and an extended position.

14. The utility knife of claim 13 wherein:

at least one of the blade stops engages an inclined end edge of the retractable blade when pressed towards the first handle member to lock the retractable blade at the retracted position.

15. The utility knife of claim 13 wherein:

at least one of the blade stops engages one or more locking notches on a top end of the retractable blade when pressed towards the first handle member to lock the retractable blade at the extended position.

16. The utility knife of claim 12 wherein:

the first handle member is comprised of a first side cover plate having an outer surface and an inner surface that are flat;

the blade adjustment opening is disposed through the first side cover plate; and the blade stops project laterally from the inner surface of the first side cover plate.

17. The utility knife of claim 16 wherein:

the second handle member is comprised of a second side cover plate having an outer surface that is flat, and having an inner surface that includes a flange that projects laterally from the second side cover plate along a top end, a rear end, and a bottom end to form a recess in the second handle member that defines the blade slot.

18. The utility knife of claim 17 wherein:

the flange projects laterally further from the inner surface of the second side cover plate than the blade stops project laterally from the inner surface of the first side cover plate.

19. The utility knife of claim 17 wherein the biasing member comprises:

a flat spring member formed by a U-shaped groove through the second side cover plate, wherein the flat spring member is bent laterally inward to contact the second side of the retractable blade.

20. A method of operating a utility knife, the method comprising:

housing a knife blade in a blade slot of a handle of the utility knife;

applying a lateral force against one side of the knife blade with a biasing member of the handle to bias the knife blade toward a first side of the handle and engage one or more blade stops disposed on the first side of the handle;

pressing laterally against an opposite side of the knife blade through a blade adjustment opening in the first side of the handle to disengage the knife blade from the blade stops;

sliding the knife blade longitudinally through the blade adjustment opening to extend or retract the knife; and releasing the knife blade to engage the blade stops via the biasing member to lock the knife blade at a new position.

* * * * *